US010094385B2

(12) United States Patent
Mikkelsen et al.

(10) Patent No.: US 10,094,385 B2
(45) Date of Patent: Oct. 9, 2018

(54) MULTI-STAGE CENTRIFUGAL PUMP

(71) Applicant: GRUNDFOS HOLDING A/S, Bjerringbro (DK)

(72) Inventors: Steen Mikkelsen, Bjerringbro (DK); Carl-Christian Danielsen, Ryomgård (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 191 days.

(21) Appl. No.: 14/882,750

(22) Filed: Oct. 14, 2015

(65) Prior Publication Data

US 2016/0108922 A1 Apr. 21, 2016

(30) Foreign Application Priority Data

Oct. 15, 2014 (EP) ..... 14188999

(51) Int. Cl.

| | |
|---|---|
| ***F04D 17/12*** | (2006.01) |
| ***F04D 1/06*** | (2006.01) |
| ***F04D 29/42*** | (2006.01) |
| ***F04D 29/62*** | (2006.01) |
| ***F04D 13/02*** | (2006.01) |

(52) U.S. Cl.

CPC ..... *F04D 17/12* (2013.01); *F04D 1/063* (2013.01); *F04D 13/021* (2013.01); *F04D 29/426* (2013.01); *F04D 29/628* (2013.01)

(58) Field of Classification Search

CPC ..... F04B 25/04; F04D 29/42; F04D 29/426; F04D 29/628; F04D 17/12; F04D 13/021

See application file for complete search history.

(56) References Cited

U.S. PATENT DOCUMENTS

| | | | | | |
|---|---|---|---|---|---|
| 2,753,807 | A | | 7/1956 | Lung | |
| 2,957,426 | A | * | 10/1960 | Miller | F04D 1/10 415/145 |
| 3,051,090 | A | | 8/1962 | Zumbusch | |
| 4,690,600 | A | * | 9/1987 | Lauer | F16B 39/02 376/364 |
| 4,842,480 | A | * | 6/1989 | Jensen | F04D 29/4266 415/199.1 |

FOREIGN PATENT DOCUMENTS

| | | |
|---|---|---|
| DE | 10 72 100 B | 12/1959 |
| DE | 12 75 866 B | 8/1968 |
| DE | 32 40 259 C1 | 2/1984 |
| EP | 2 348 221 A1 | 7/2011 |

* cited by examiner

*Primary Examiner* — Woody Lee, Jr.

*Assistant Examiner* — Maxime Adjagbe

(74) *Attorney, Agent, or Firm* — McGlew and Tuttle, P.C.

(57) ABSTRACT

A multistage centrifugal pump includes a foot part (1) and a head part (7), between which several pump stages are arranged. Each of the pump stages includes an impeller (4) and a housing (5) surrounding the impeller (4). The housings (5) are arranged over one another. The housings (5) together with an outer casing (9) form an annular channel (8). The housings (5) together with an outer casing (9) are clamped via clamping bolts (11) which are fastened on the head part (7) and the foot part (1). The clamping bolts (11) are arranged within the annular channel (8).

20 Claims, 8 Drawing Sheets

MULTI-STAGE CENTRIFUGAL PUMP

CROSS REFERENCE TO RELATED APPLICATIONS

This application claims the benefit of priority under 35 U.S.C. § 119 of European Patent Application 14 188 999.8 filed Oct. 15, 2014, the entire contents of which are incorporated herein by reference.

FIELD OF THE INVENTION

The invention relates to a multi-stage centrifugal pump with a foot part which comprises a suction connection and a delivery connection and with a head part.

BACKGROUND OF THE INVENTION

The invention departs from the state of the art, as is known for example with the Grundfos pump construction series of the type CR and CRE. With regard to these pumps, it is the case of multi-stage, vertically operated centrifugal pumps with a foot part and with a head part, between which at least two pump stages are arranged, said pump stages each comprising an impeller and a housing surrounding this. The suction connection and the delivery connection of the pump are formed in the foot part. The fluid to be delivered gets through a suction branch, which is likewise arranged in the foot part of the pump, firstly into the first pump stage and further up to the last pump stage, where it is led back into the foot part again via an annular channel formed between the outer casing and the housings, and there is led out of the pump via a delivery branch. The drive shaft of the pump which connects the impellers is led out through the head part in a sealed manner, where a motor bracket connects, said motor bracket being provided for receiving an electrical drive motor and in which the pump-side shaft is coupled in movement to the motor-side shaft. With regard to the above mentioned pump construction series, it is the case of pumps which are vertically operated, which means to say are operated in a manner standing on the foot part with a vertical impeller axis, but for the present invention it is basically of no concern as to whether the pump is operated vertically or in any other position.

With these known pumps, the head part and the foot part are typically formed from a metallic cast material, whereas the outer casing consists of sheet metal shaped into a cylinder. The outer casing and the pump stages are clamped between the head part and foot part and are held by four clamping bolts which are led through bores in corners of the head part and foot part, said corners laterally projecting beyond the cylinder body.

The pumps of the previously mentioned construction series have proven their worth and are on the market in numerous different power and housing embodiments.

Stress conditions within the pump can undesirably change, if such pumps are operated at high temperature differences between the medium to be delivered and the environment, since the clamping bolts (tension bolts) undergo a different thermal expansion than the housings of the pump stages. Objects or flying parts can jam or at least settle in this region, on account of the clamping bolts which are arranged at a small distance to the housing casing, and this is not desirable. These clamping bolts also upset the overall optical impression of the pump, which is otherwise impressed by the simple cylinder casing which is mostly formed from stainless steel. A cladding of the clamping bolts however is mostly cumbersome and expensive.

A multi-stage pump from U.S. Pat. No. 2,957,426 is counted as belong to the state of the art and with this, the pump stages can be selectively connected in parallel or in series. The individual pump stages are connected there via stud bolts which partly run through the pressure channel and connect the pump stages to an end-part of the pump housing peripherally surrounding all pump stages and at a distance at a face side.

SUMMARY OF THE INVENTION

Departing from the first mentioned state of the art, it is an object of the present invention to provide a multistage centrifugal pump of the known type, such that the mentioned disadvantages are at least avoided or possibly prevented.

The multistage centrifugal pump according to the invention comprises a foot part and a head part, between which at least two pump stages are arranged, said pump stages each comprising an impeller and a housing surrounding this. These housings are surrounded at a distance by an outer casing, so that an annular channel is formed, wherein clamping bolts are provided, which connect the head part and the foot part to one another amid the inclusion of the casing and the housings. According to the invention, the clamping bolts are arranged in the annular channel between the outer casing and the housings.

The basic concept of the present invention is thus to not to lead the clamping bolts clamping the pump stages between the head part and the foot part as well as the outer casing between the head part and foot part, along the outer side of the outer casing, but within the outer casing and specifically in the annular channel which is formed by the housings of the pump stages and the outer casing.

The arrangement according to the invention has numerous advantages. Apart from the optically pleasing appearance of the pump, one can prevent objects from settling or even jamming here, due to the clamping bolts which are arranged in a manner covered by the outer casing.

A significant technical advantage lies in the fact that the clamping bolts, the outer casing and pump stage always have the same temperature level, specifically that of the delivery fluid, due to the arrangement of the clamping bolts in the annular channel, thus where delivery fluid flows along. This is particularly advantageous if, on the one hand, delivery fluids with a greatly fluctuating temperature level are delivered, and on the other hand the temperature of the delivery fluid differs greatly from the surrounding temperature of the pump. This allows the thermal expansions of the clamping bolt on the one hand, and those of the pump stages on the other hand, to essentially always be effected to the same extent, due to the arrangement of the clamping bolts within the delivery fluid flow, so that no load peaks due to temperature can occur here. Thereby, it is to be assumed that both pump stages, at least however the housings and the clamping bolts, typically also the outer casing, consist of the same type of materials, typically metal, which have an essentially equal coefficient of expansion.

Moreover, it has been found that stud bolts arranged within the annular channel form a type of guidance for the delivery fluid, so that a significantly reduced eddying of the fluid occurs at the delivery branch than is the case of comparable pumps of a conventional construction type, at least when the annular channel is subjected to through-flow at the delivery side.

Moreover, the pressure-effective surface area onto the head part or the foot part is reduced by the cross-sectional area of the clamping bolts, due to the inward relocation of the clamping bolts.

The annular channel is advantageously connected such that the annular channel connects the delivery-side exit, preferably of the last pump stage, to the delivery connection of the pump, in a fluid-leading manner, as is the case with the initially mentioned pump construction series according to the state of the art. The previously mentioned advantages with regard to flow technology result with this arrangement, and moreover the pressure effective surface areas within the pump housing and thus the effective forces are reduced by way of the clamping bolts.

Alternatively, the centrifugal pump according to the invention can also be constructed such that the annular channel is provided at the suction connection side, which means connects a suction connection of the pump to a suction entry, preferably of the first pump stage. With this arrangement, the pressure loading, in particular of the outer casing is significantly lower than with the other variant.

It is advantageous with regard to design, if at least two clamping bolts are provided, which are arranged at the same angular distance in the annular channel. This ensures a minimum of uniformity with regard to the introduction of forces. Preferably however, four clamping bolts which are angularly arranged at a distance of 90° with respect to the impeller axis in a uniformly distributed manner are provided in the annular channel, with the solution according to the invention. This arrangement is particularly advantageous with regard to the force introduction as well as with regard to the leading of the flow.

As to where the clamping bolts are arranged within the annular channel is basically freely selectable. However, it has been found to be particularly advantageous if the clamping bolts are arranged in the middle of the annular channel in the radial direction, since they are then favorably subjected to peripheral flow. Moreover, the risk of acoustic noise is reduced, which could arise in the case if the outer casing touches the clamping bolts during operation. Radially in the middle thereby means between the inner side of the outer casing and the outer sides of the housings of the pump stages, and specifically at the same radial distance to both.

The clamping bolts are advantageously provided with an outer thread at least at one end, preferably however at both ends, so that they can either be tightened at both sides by way of bolts which are supported on the head part or foot part. Advantageously however, bores can also be provided on the head part side or foot part side and these be provided with an inner thread, into which an end of the clamping bolt can then be screwed, so that a fastening by way of the nut is only effected at the other end. Thereby, the bores are preferably designed as through-bores, so that no corrosion-encouraging fluid can collect in the bore. Thereby, a pocket-hole bore can also be provided instead of a through-bore, and this pocket-hole bore close to the end comprises an outwardly leading channel, for example in the form of a transverse bore, in order to be able to lead away this corrosion-encouraging fluid to the outside as the case may be. Alternatively, one end of a clamping bolt can also be formed via other positive fit means, for example in the form of a hook or a radially widened cylindrical shoulder engaging into a corresponding receiver on the inner side of the foot part or head part. If for example a hook is provided at the end of a clamping bolt, then a web is provided at the foot part side or head part side, into which this can be hooked. A suitable other positive-fit connection can also be provided.

It is useful to provide a seal—sealing means—between the clamping bolt and the head part and/or foot part, in particular when the annular channel is arranged at the delivery side, but also with a suction-side arrangement. Such a sealing means is to be provided when the clamping bolt or a component connected thereto passes through the head part or the foot part. According to the invention, a multitude of solutions are envisaged for sealing off this region, and these are yet described in more detail further below.

A good and simultaneously economical sealing results if a seal is arranged between the clamping bolt and through-bore, and the clamping bolt is designed in a thread-free manner in this region of the seal. An O-ring can advantageously serve for this, which is inexpensive and reliable. The O-ring can sealingly bear on the thread-free part of the camping bolt over the whole periphery, and a sealing here is thus significantly more effective and more simply possible that in the region of the thread. A smooth, for example cylindrical wall is likewise to be provided on the through-bore side, and, as the case may, be shoulders, grooves or other aids can be provided, in order to hold the seal, in particular the O-ring at the envisaged location.

According to a further development of the invention, a groove-like seal seat is provided on the clamping bolt side, for fixing the O-ring at the location between the clamping bolt and for example the through-bore in the head part, said location with regard to the design being envisaged for this fixation, wherein the groove-like seal seat comprises a first contact shoulder which is formed by a ring fixed in a groove on the clamping bolt, and a second contact shoulder which is formed by a further ring which comprises an inner thread and is fixed on the threaded section of the clamping bolt. Thereby, the arrangement is usefully such that it is the case of a thread section of the thread, with which the clamping bolt is fixed and tensioned on the housing side, thus typically on a section of the outer thread which is provided at one end.

Alternatively, the fixation of the clamping bolt on the head part or foot part can be effected by way of a cap nut which on one side comprises a collar which projects radially beyond the through-bore and with which this cap nut can be supported on the other side of the through-bore, on the head part or foot part. Moreover, the cap nut has a hollow-cylindrical section which engages into the through-bore, comprises a peripheral groove on its outer periphery as a seal seat for the O-ring and is provided with an inner thread, into which the thread at the end of the tie-rod engages.

Alternatively, a seal seat for an O-ring can be formed by a ring which is provided with an inner thread and which is fixed on a thread section of the clamping bolt. A peripheral groove is then advantageously provided on the through-bore side, into which groove the O-ring is positively held, in order to bear with its inner side on the seal seat formed by the ring. A groove does not necessarily need to be provided, it is also conceivable for a shoulder to be provided close to the end of the through-bore, in which shoulder the O-ring is received. The seal seat, thus the receiver for the O-ring can then be formed by this part of the through-bore which is widened in a stepped manner, in combination with a covering washer, wherein the washer replaces the third wall in the through-bore, said third wall being otherwise formed by the groove.

A modular construction, for example of clamping bolt sections which at one end are provided with a bore provided with an inner thread and at the other end are provided with an outer thread, and which is thus suitable for extending the clamping bolt, is conceivable, since according to the invention, the clamping bolts lies at the inside, thus where they are not visible to the user. Constructionally identical clamping bolts can be used in this manner for construction series of pumps with a different number of stages, and these clamping bolts are brought to the desired length by way of one or more suitable extensions. Thus one can use the same clamping bolts with pumps having different head parts, wherein a necessary adaptation is effected by way of such an extension part.

Advantageously, according to a further development of the invention, the ratio of the surface areas which are pressure-effective with regard to the loading of the clamping bolt and are loaded by the exit pressure of the pump and by the entry pressure of the pump is at least two, preferably between three and five. This surface area ratio is particularly advantageous, since the inner-lying arrangement of the clamping bolts practically has no noticeable influence on the exit pressure of the pump, so that the exit pressure of the pump corresponds roughly to that which a comparable pump musters with clamping bolts arranged on the outside and with the same drive power.

The invention is hereinafter explained in more detail by way of embodiment examples represented in the figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
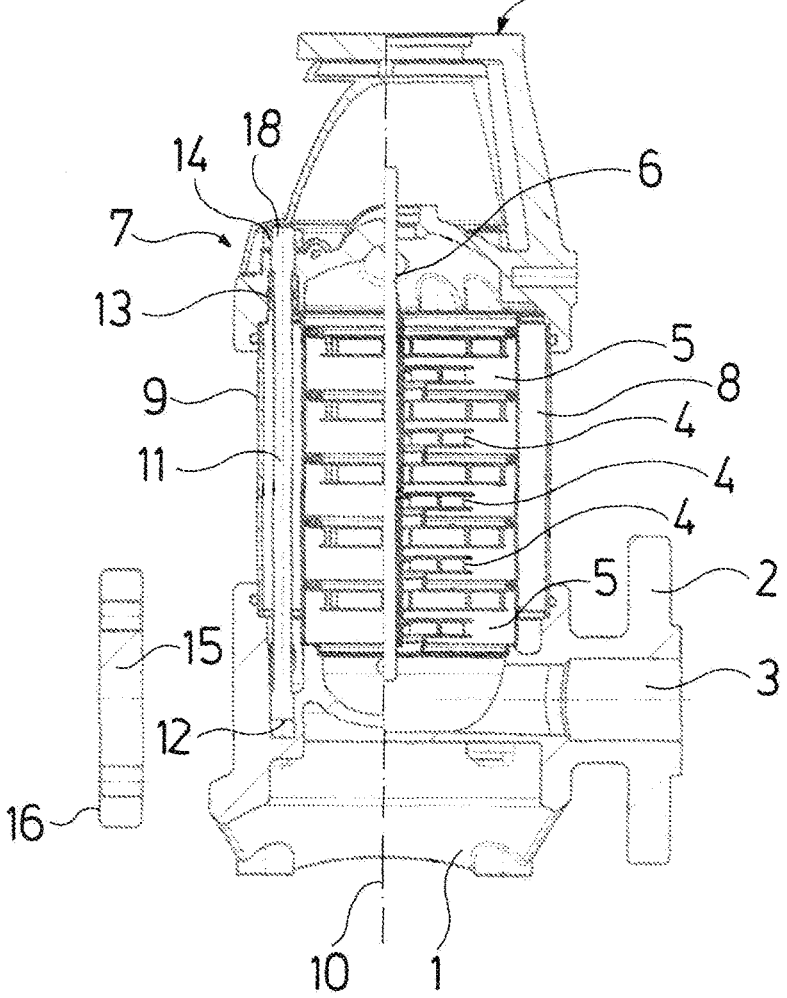
FIG. 2 is a sectional view along the section line A-A in FIG. 1.
Figure 1:
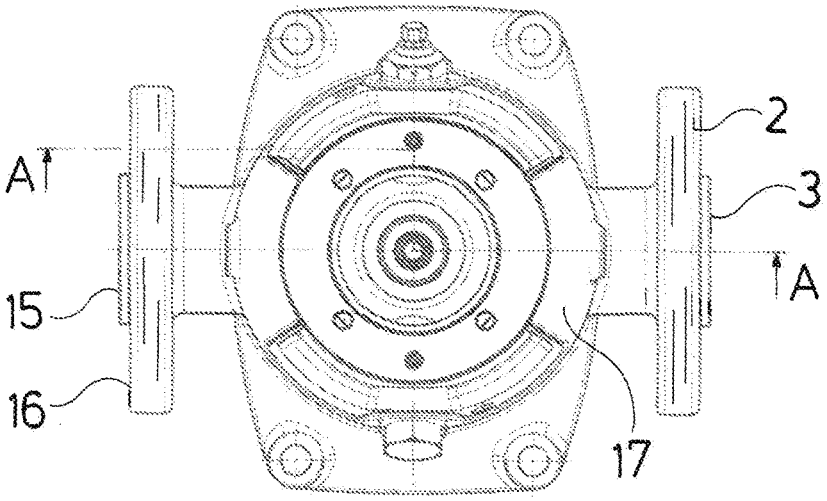
FIG. 1 is a plan view of a vertical, multi-stage centrifugal pump of the inline construction type.
Figure 4C:
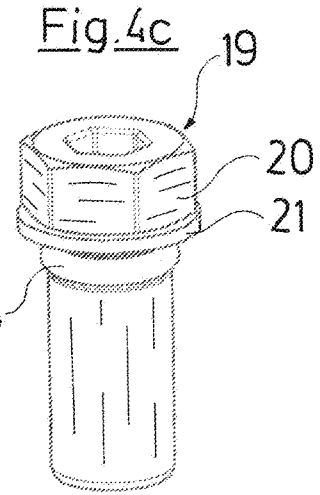
FIG. 4*c* is a perspective view of the components according to FIG. 4*b* in an assembled form.
Figure 4D:
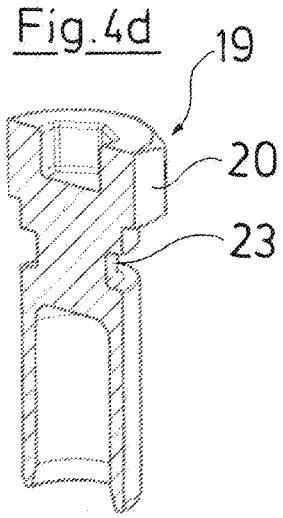
FIG. 4*d* is a longitudinal sectional view showing the cap nut of FIG. 4*b;*
Figure 4A:
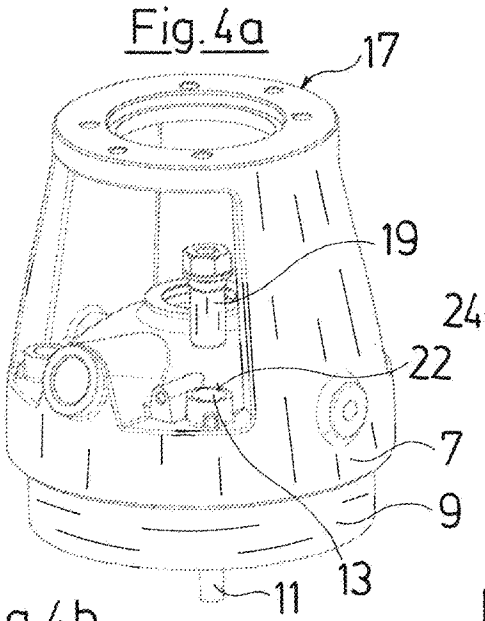
FIG. 4*a* is a schematic, perspective exploded representation showing a head part with a cap nut for fastening a tie-rod.
Figure 4B:
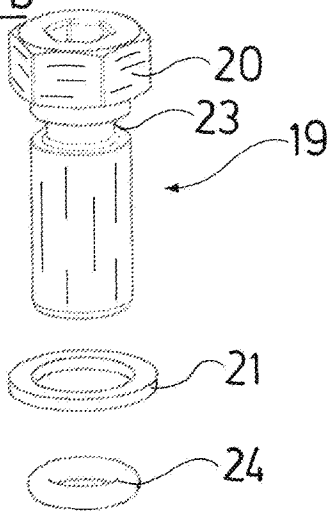
FIG. 4*b* is an enlarged perspective exploded representation showing the cap nut with a washer and sealing ring.

Referring to the drawings, the basic construction of the vertical, multi-stage centrifugal pump described herein is firstly represented by way of FIGS. 1 and 2. The pump comprises a foot part 1, on which the pump is operated. The foot part 1 comprises a connection flange 2 which forms the suction branch of the pump and which surrounds a suction channel 3 running out within a suction space which is formed in the foot part 1 and to which the suction port of an impeller 4 of the first pump stage connects, said first pump stage being formed by the impeller 4 and a housing 5 surrounding this. As a whole five stages each consisting of an impeller 4 and a housing 5 are arranged vertically over one another with the pump represented by way of FIG. 2, wherein the impellers 4 are seated on a common shaft 6 which is rotatably mounted within the pump housing and is led out at the upper side, specifically in the region of this head part 7.

The housings 5 are designed cylindrically at their outer side and are sealingly arranged on one another. They delimit an annular channel 8 on the inner side which is delimited at the outside by an outer casing 9 consisting of sheet metal and forming part of the pump housing. The outer casing 9 and the housing 5 are clamped between the foot part 1 and the head part 7, and the clamping forces which are necessary for this are formed by four tie-rods in the form of clamping bolts 11, which are arranged distributed at an equal angular distance about the longitudinal axis 10 of the pump which also forms the rotation axis 10 of the shaft 6.

Each clamping bolt 11 at its two ends is provided with an outer thread which is screwed with one end in a bore 12 on the foot part 1, said bore being provided with an inner thread. The other end with the embodiment according to FIG. 2 is led through a through-bore 13 in the head part 7 and tightened there by way of a nut 14.

This design principle which is represented by way of FIG. 2 can be varied with regard to the fastening on the foot part side as well as the fastening on the head part side, as already mentioned beforehand. Inasmuch as it concerns the fastening on the head part side, suitable alternatives are represented by way of FIGS. 3-11, which however are also basically suitable for a foot-side fastening.

The four clamping bolts 11 are not only arranged in the annular channel 8 in a manner distributed at the same angular distance of 90° about the longitudinal axis 10, but also arranged radially centrally in the channel 8, so that they have the same distance to the outer side of the housing 5 and to the inner side of the outer casing 9. This annular channel 8 runs out within the foot part 1 in a pressure channel 15 leading to a delivery connection 16 whose connection flange is visible in FIGS. 1 and 2.

The head part 7 of the pump is extended to the top and there is formed into a motor bracket 17 in the manner known per se, and this motor bracket is envisaged for fastening the electrical drive motor which comes to bear thereon and whose shaft is connected in a rotationally fixed manner to the free end of the shaft 6 via a coupling which is not shown here, Since the clamping bolts 11 are fixed in through-bores 13 of the head part, these bores need to be sealed with respect to the head part, in order to ensure the sealedness of the housing in this region. With the embodiment represented by way of FIG. 3, the end 18 of the clamping bolt 11 which is on the head part side and is provided with a thread does not reach through the through-bore 13, but only up to into this. The end 18 of the clamping bolt 11 which is provided with the thread is received in a cap nut 19 as is shown in detail by way of FIG. 4. This cap nut 19 comprises a head 20 which with the represented embodiment has a hexagonal socket as well as an outer hexagonal for receiving a tool, and with regard to magnitude is designed such that it radially projects beyond the through-bore 13. This radially projecting head, in the assembled condition via a washer 21, bears on the respective screw head rest surface 22 which is formed above the through-bore 13 in the head part 7.

The cap nut 19 is designed cylindrically from the head 20 on, wherein a peripheral groove 23 is provided at a short distance behind the head and this serves for receiving an O-ring 24 which is held within this groove 23 and which seals the cap nut 19 within the through-bore 13 in the head part 7. The cap nut on the other side of the groove 23 is designed in a hollow-cylindrical manner and comprises an inner thread 25, in which the end 18 of the clamping bolt 11 which is provided with a thread engages. The clamping bolt 11 which is fixed with its other end in the foot part 1 is tightened and sealed with respect to the through-bore 13 by way of the seal in the form of a the O-ring 24, with this cap nut 19.

A fastening of the clamping bolt 11 by way of a cap nut 26, said fastening being on the head part side, is represented by way of FIG. 5, and this cap nut differs from the previously described cap nut 19 in that the washer 21 provided there can be done away by way of a suitable design of the annular surface below the head as well as the head rest surface. The head part 7 is only shown there in the region of the through-bore, since only the fastening and sealing are to be shown in this representation. The through bore 13 is widened to the inside of the pump housing and this widened region is characterized at 27 and to the inside of the pump housing connects onto the cylindrical part of the through-bore 13, on which the O-ring 24 lying in the groove 23 of the cap nut 26 sealingly bears. A transverse bore 28 is provided close to the inner end, in the cylindrical region of the cap nut 26, in which region this cap nut is provided with the inner thread 25, wherein this transverse bore transversely passes through the cap nut 26 and on the one hand runs out in the pocket hole of the cap nut 26 which is provided with an inner thread and on the other hand lead to the widened region 27 of the through-bore 13, so that it is ensured that no dead space is formed within the cap nut 26, in which space corrosions-encouraging fluid can collect. With this design, the clamping bolt 11 in the region between its shank and the thread end 18 is provided with a peripheral bed 29 which prevents too far a rotation into the inner thread 25 of the cap nut, so that this transverse bore 28 is not enclosed by the part 18 of the clamping bolt 11 which is provided with the thread.

Figure 6:
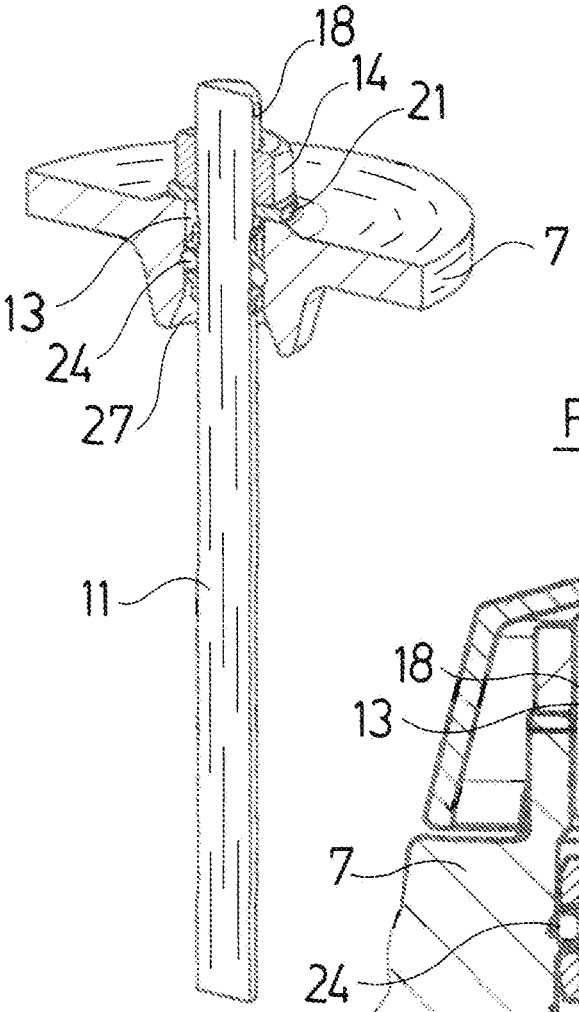
FIG. 6 is a schematic perspective longitudinal sectional representation showing an alternative design of the connection.
Figure 7:
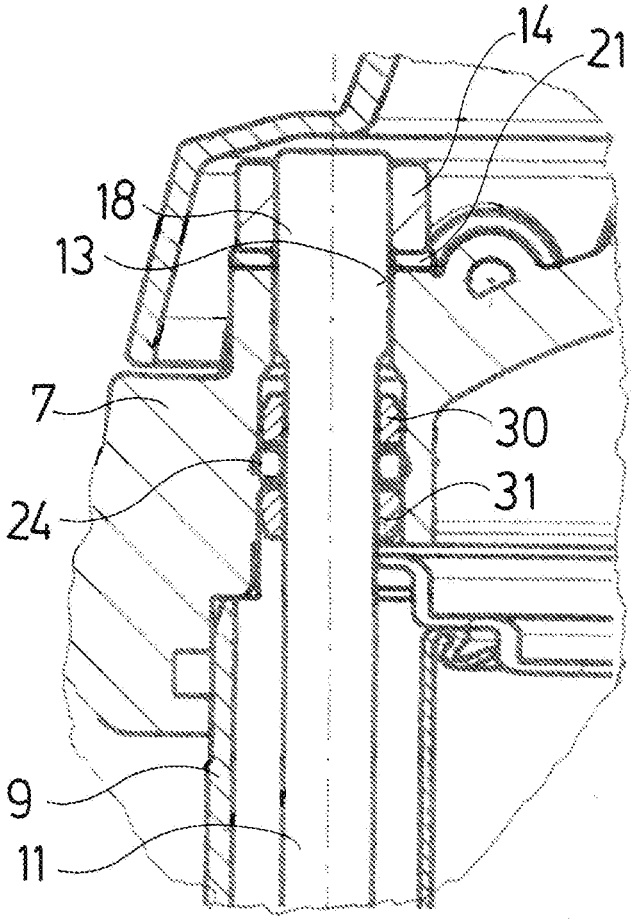
FIG. 7 is an enlarged sectional representation showing a detail of a connection, according to FIG. 6, to a head part of the pump.

The clamping bolt 11 passes completely through the through-bore 13, with the embodiment represented by way of FIGS. 6 and 7, and there at its end 18 provided with the thread, is fixed in the head part 7 by way of the nut 14 amid the integration of a washer 21. The clamping bolt 11, which is manufactured of round steel material with the embodiment according to FIG. 6, at its ends comprises sections 18 which are provided with a thread and which are manufactured by way of rolling, so that the diameter is slightly larger than the region which is not provided with the thread, as is evident from FIG. 7. The through-bore 13 is designed in a shouldered manner, so that a free space is formed in this region, between the clamping bolt 11 and the through-bore 13, said free space permitting the integration of the sealing ring in the form of the O-ring 24. Two rings 30 and 31 which are clampingly fastened on the clamping bolt 11 and which receive the O-ring 24 are provided for holding the O-ring 24 in its designated position, since the through-bore 13 is also designed in a smooth-walled manner in the shouldered region. These rings can be seated on the clamping bolt 11 with a non-positive or also material fit. The ring 30 can be provided with an inner thread which can be screwed from the middle onto the thread on the section 18, said latter mentioned thread then being designed in a longer manner compared to FIG. 7, and the ring can be fixed in the clamping bolt 11 via a groove. The rings 30 and 31 can be designed in a two-part manner and be fastened by clip, and they can consist of plastic due to the fact that they are loaded to a very low extent with regard to forces.

Figure 8:
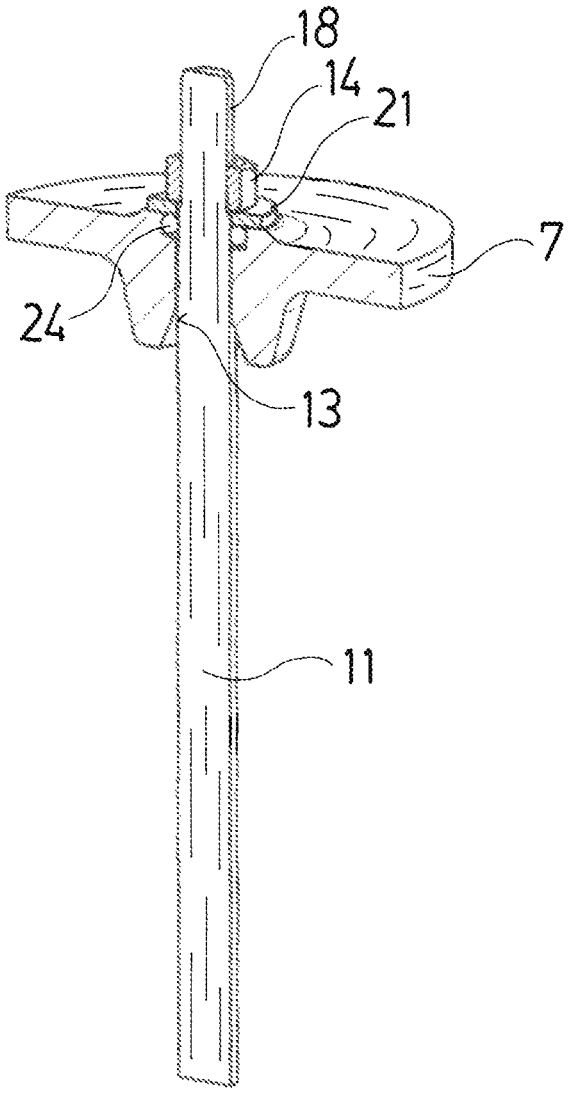
FIG. 8 is a schematic perspective longitudinal sectional representation showing a further embodiment of a connection between a tie-rod and the head part.

With the embodiment represented by way of FIG. 8, the clamping bolt 11 is manufactured of round material of steel, but the end 18 provided with a thread is not manufactured by rolling there, but by way of cutting, so that the thread section 18 has a lower diameter than the remaining part of the clamping bolt 11. The fastening of the clamping bolt 11 is basically possible as described by way of FIG. 6, by way of a nut 14 amid the integration of a washer 21. The sealing between the clamping bolt 11 and the through-bore 13 is likewise effected by way of the O-ring 24 which is arranged in the region of the clamping bolt 11 which carries no thread. The part of the through-bore 13 which is at the top in FIG. 8 is designed in a shouldered manner, so that the O-ring 24 is held on the outer periphery and on the lower side by way of this shouldered part of the through bore, on the inner side by clamping bolt 11 and on the upper side by the washer 21, in order to securely hold the O-ring 24 in its position.

Figure 9:
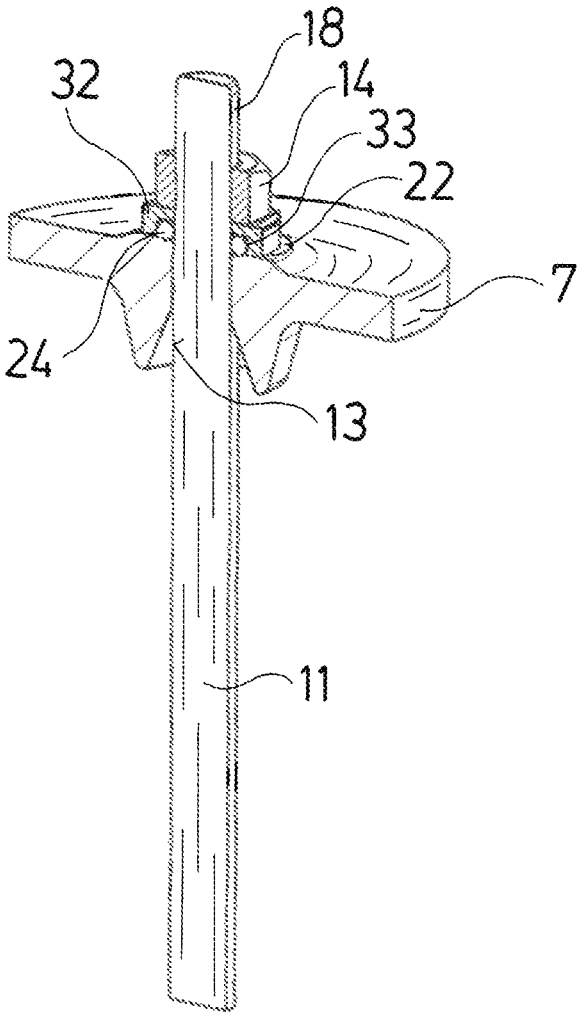
FIG. 9 is a schematic perspective longitudinal sectional representation showing a further design of a connection between the tie-rod and the head part.

With the embodiment according to FIG. 9, the fixation of the O-ring is effected within a separate component 32 which on the one hand has the function of a washer, but on the other hand is designed shouldered on the inner side, so that the O-ring 24 is received in this shouldered part of the component 32 which is characterized in FIG. 9 at 33. The O-ring 24 with this arrangement must seal to the clamping bolt 11 on the one hand as well as to the head rest surface 22 of the through-bore 13 on the other hand.

Figure 10:
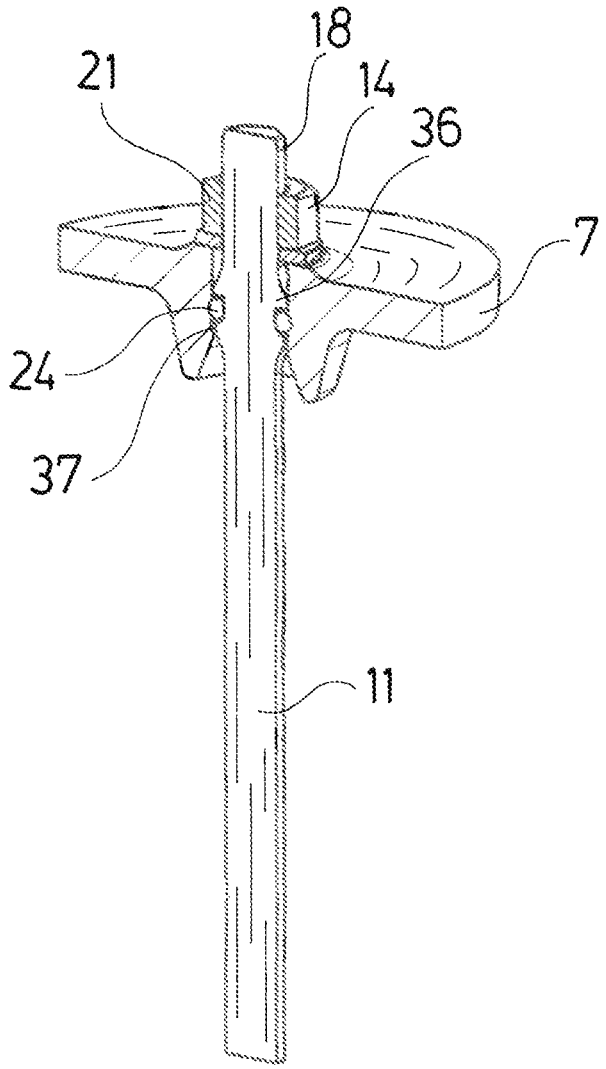
FIG. 10 is a schematic perspective longitudinal sectional representation showing a further design of the connection between the tie-rod and the head part.

Finally, FIG. 10 shows a further sealing variant between the clamping bolt 11 and the through-bore 13. The clamping bolt 11 here comprises a widened bead-like region 36 between the smoothed-walled region and the region 18 provided with the thread, into which bead-like region a peripheral groove 37 is machined, in which the O-ring 24 lies. The through-bore 13 in the head part 7 in this case is designed in a cylindrical manner in the region where the O-ring 24 comes into bearing contact.

Figure 3:
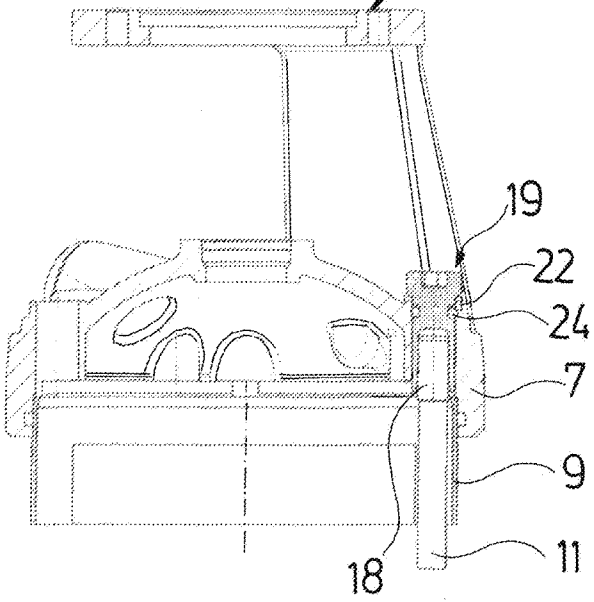
FIG. 3 is an enlarged part section representation, the head part with a connecting outer casing and with a tie-rod connection of the pump according to FIG. 1.
Figure 11:
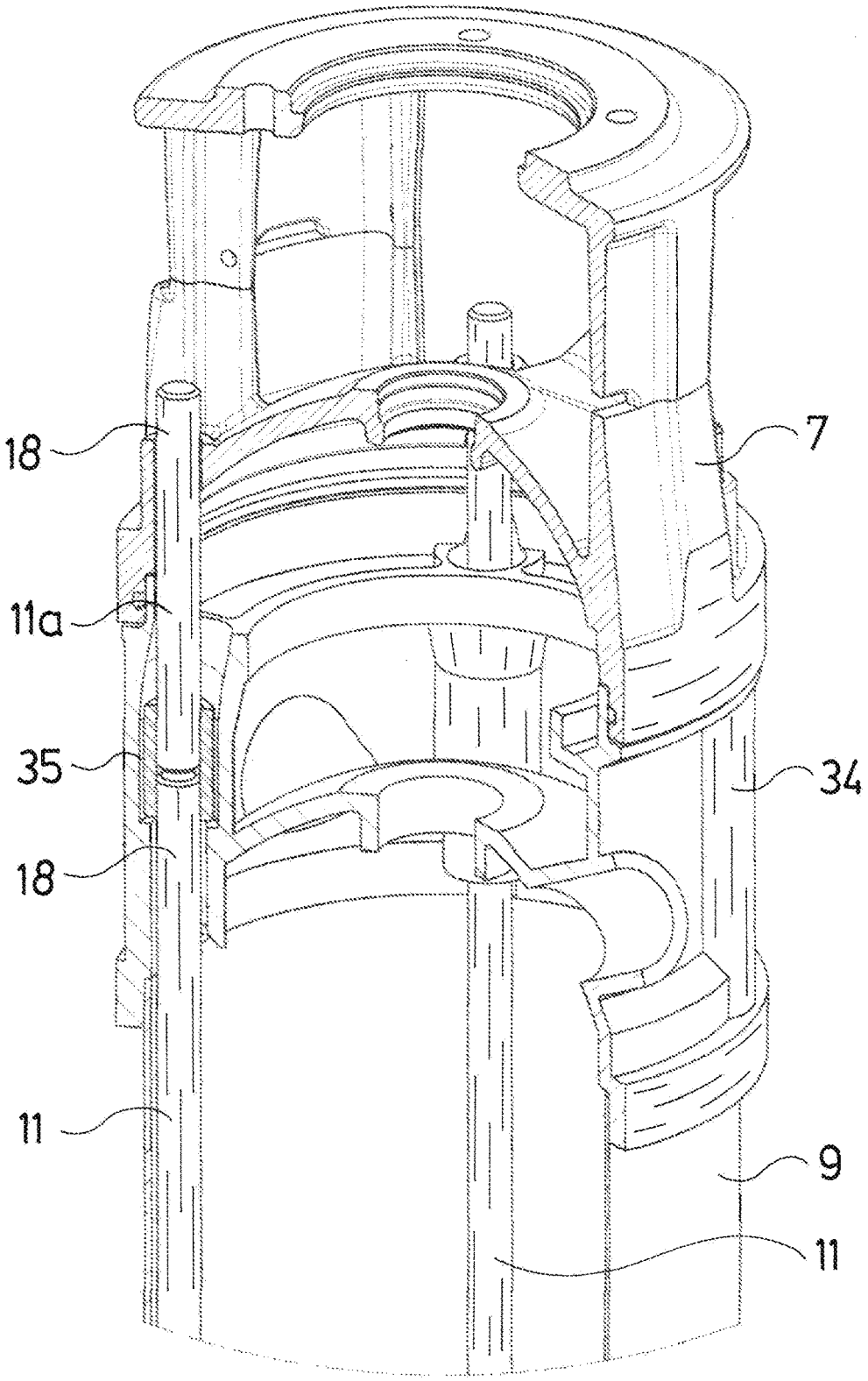
FIG. 11 is a schematic perspective part-section representation of a fastening of the tie-rod on a more highly constructed head part.

A vertical, multi-stage centrifugal pump is represented in the region of the head part by way of FIG. 11, with which pump the head part is constructed higher than with the design represented by way of FIG. 2 or 3. There specifically, an intermediate head part 34 is integrated between the actual head part 7 and the outer casing 9, which leads to the fact that the clamping bolt 11, given the same pump stage number of the pump, would have to be designed longer than with the version according to FIG. 2 or 3. The clamping bolts 11 with the embodiment variant represented by way of FIG. 11 are constructed in a multi-part manner for this, and specifically they consist of the actual clamping bolts 11 in the length as would be envisaged for the fastening of the head part 7, and of a clamping bolt part 11*a*, and these are connected to one another via a threaded sleeve 35. In the shown embodiment, the component 11*a* and 25 are of two pieces, but one can also provide a clamping bolt section 11*a* which at one end comprises a threaded section 18 and at the other end threaded sleeves 35 for receiving the threaded section 18 of the clamping bolt 11 connecting thereto. It is possible in this manner to construct a clamping bolt in a modular manner, so that given a suitable choice of module lengths with a comparatively low number of clamping bolts 11 and clamping bolt extensions 11*a*, different construction shapes and complete construction series can be covered with regard to the clamping bolts, without a comparable number of differently long clamping bolts becoming necessary.

While specific embodiments of the invention have been shown and described in detail to illustrate the application of the principles of the invention, it will be understood that the invention may be embodied otherwise without departing from such principles.

APPENDIX: List of Reference Numbers

Figure 5:
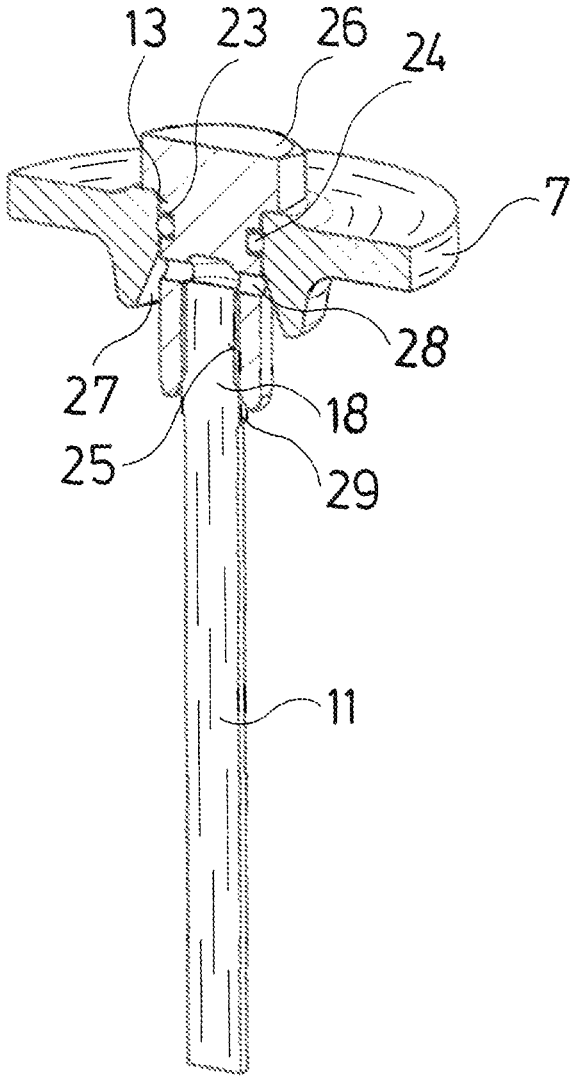
FIG. 5 is a schematic perspective longitudinal sectional representation showing a head-side connection to a tie rod.

| | |
|---|---|
| 1 | foot part |
| 2 | connection flange of the suction channel |
| 3 | suction channel |
| 4 | impeller |
| 5 | housing |
| 6 | shaft |
| 7 | head part |
| 8 | annular channel |
| 9 | outer casing |
| 10 | longitudinal axis, rotation axis |
| 11 | clamping bolts |
| 11a | clamping bolt extension |
| 12 | bore in the foot part |
| 13 | through-bore in the head part |
| 14 | nut |
| 15 | pressure channel |
| 16 | delivery connection |
| 17 | motor bracket |
| 18 | end of 11 which is provided with a thread |
| 19 | cap nut |
| 20 | head of cap nut |
| 21 | washer |
| 22 | head rest |
| 23 | groove of cap nut |
| 24 | O-ring |
| 25 | inner thread in the cap nut |
| 26 | cap nut in FIG. 5 |
| 27 | widened region of 13 |
| 28 | transverse bore |
| 29 | bead |
| 30 | ring |
| 31 | ring |
| 32 | component |
| 33 | shouldered part |
| 34 | intermediate head part |
| 35 | threaded sleeve |
| 36 | bead-like region |
| 37 | groove |

What is claimed is:

1. A multi-stage centrifugal pump comprising:

a foot part comprising a suction connection and a delivery connection for the entirety of a working fluid of the multi-stage centrifugal pump;

a head part;

at least two pump stages arranged between the foot part and the head part, each of said stages comprising an impeller and a housing surrounding the impeller;

an outer casing surrounding each housing at a distance and forming an annular channel;

clamping bolts connecting the head part and the foot part to one another amid the inclusion of the casing and the housings, wherein the annular channel leads delivery fluid to one of the suction connection and the delivery connection, wherein the clamping bolts are arranged in the annular channel.

2. A centrifugal pump according to claim 1, wherein the annular channel fluidically connects a delivery-side exit of at least one of the pump stages to the delivery connection of the pump.

3. A centrifugal pump according to claim 1, wherein the annular channel fluidically connects a suction connection of the pump to a suction entry of at least one of the pump stages.

4. A centrifugal pump according to claim 1, wherein the clamping bolts are arranged spaced apart at a same angular distance in the annular channel, each of the clamping bolts being arranged between an inner surface of the outer casing and said housing of each of said stages, wherein each of the clamping bolts is arranged in a delivery flow path of the delivery fluid, the delivery flow path comprising the annular channel.

5. A centrifugal pump according to claim 1, wherein the clamping bolts are each arranged radially centrally between the inner side of the outer casing and the outer sides of the housing.

6. A centrifugal pump according to claim 1, wherein the clamping bolts are provided with an outer thread at least at one end, each of the clamping bolts being located radially inward of an inner surface of the outer casing relative to a rotation axis of the impeller associated with one of the pump stages.

7. A centrifugal pump according to claim 6, wherein the clamping bolts are provided with an inner thread and, on the foot part side or on the head part side, are each fastened in one of a plurality of bores.

8. A centrifugal pump according to claim 7, wherein:

the bores are though-bores; and the clamping bolts on the head part side or foot part side are led up to/through the through-bores in the head part or foot part and are fastened by nuts.

9. A centrifugal pump according to claim 1, further comprising a seal provided at least one of between the clamping bolt and the head part and between the clamping bolt and the foot part.

10. A centrifugal pump according to claim 9, wherein:

the seal is an O-ring arranged between the clamping bolt and a through-bore; and the clamping bolt is thread-free in the region of the seal.

11. A centrifugal pump according to claim 10, wherein an O-ring seat is formed on the clamping bolt, the seat comprising a first contact shoulder which is formed by a first ring fixed in a groove on the clamping bolt and with a second contact shoulder formed by a second ring having a second ring inner thread and which is fixed on a threaded section of the clamping bolt.

12. A centrifugal pump according to claim 1, wherein cap nuts, each comprising a collar projecting radially beyond a through-bore, as well as a peripheral groove in the region of the through-bore, form a seal seat for an O-ring.

13. A centrifugal pump according to claim 1, wherein a seal seat for an O-ring is formed by a ring with an inner thread, the ring being fixed on a threaded section of the clamping bolt, in combination with a peripheral groove in an associated through-bore.

14. A centrifugal pump according to claim 1, wherein a seal seat is formed by a part of a through-bore which is widened in a stepped manner, in combination with a covered washer.

15. A centrifugal pump according to claim 1, wherein each clamping bolt is constructed in a two-part or multi-part manner, from clamping bolt sections which are connected to one another by way of thread connections.

16. A centrifugal pump according to claim 1, wherein a ratio of surface areas, which are pressure-effective for the loading of the clamping bolts and which are loaded by an exit pressure of the pump and by an entry pressure of the pump, is at least two.

17. A centrifugal pump according to claim 1, wherein the clamping bolts are arranged within the annular channel form a type of guidance for the delivery fluid, the head part comprising a plurality of inner bores, each of the inner bores receiving at least a portion of one of the clamping bolts, the head part being in direct contact with the outer casing, the head part comprising an outer surface defining an outermost surface of the centrifugal pump, the inner bores being located radially inward of the outermost surface with respect to a longitudinal axis of the head part.

18. A multi-stage centrifugal pump comprising:

a foot part comprising a suction connection and a delivery connection;

a head part;

a plurality of pump stages arranged between the foot part and the head part, each of the stages comprising an impeller and a housing surrounding the impeller;

an outer casing surrounding each housing associated with the plurality of pump stages, the outer casing comprising an inner casing surface, the inner casing surface and each housing associated with the plurality of pump stages defining an annular channel, the annular channel defining at least a portion of an entire pressurized fluid flow path, wherein the annular channel is in fluid communication with one or of more of the suction connection and the delivery connection for delivering a delivery fluid to at least one of the suction connection and the delivery connection;

a plurality of clamping bolts, the head part being connected to the foot part via the plurality of clamping bolts, at least a portion of each of the clamping bolts being arranged in the annular channel, wherein a compressive force is applied to the entire pressurized fluid flow path via the clamping bolts being connected to the foot part and the head part, the entire pressurized fluid flow path comprising the at least one of the suction connection and the delivery connection, the annular channel and the plurality of pump stages.

19. A centrifugal pump according to claim 18, wherein each of the clamping bolts is located radially inward of the inner surface of the outer casing relative to a rotation axis of the impeller associated with one of the pump stages, the head part comprising a plurality of inner bores, each of the inner bores receiving at least a portion of one of the clamping bolts, the head part being in direct contact with the outer casing, the head part comprising an outer surface defining an outermost surface of the centrifugal pump, the inner bores being located radially inward of the outermost surface with respect to a longitudinal axis of the head part.

20. A multi-stage centrifugal pump comprising:

a foot part comprising a suction connection and a delivery connection;

a head part;

a plurality of pump stages arranged between the foot part and the head part, each of the stages comprising an impeller and a housing surrounding the impeller;

an outer casing surrounding each housing associated with the plurality of pump stages, the outer casing comprising an inner casing surface, the inner casing surface and each housing associated with the plurality of pump stages defining an annular fluid flow path, the annular fluid flow path being in fluid communication with one or of more of the suction connection and the delivery connection for delivering a delivery fluid to at least one of the suction connection and the delivery connection;

a plurality of clamping bolts, the head part being connected to the foot part via the plurality of clamping bolts, at least a portion of each of the clamping bolts being arranged in the annular fluid flow path, wherein a compressive force is applied to an entire pressurized fluid flow path via the clamping bolts being connected to the foot part and the head part, the entire pressurized fluid flow path comprising the annular fluid flow path, the plurality of pump stages and the at least one of suction connection and the delivery connection.

* * * * *